US006493978B1

(12) United States Patent
Perkins

(10) Patent No.: US 6,493,978 B1
(45) Date of Patent: Dec. 17, 2002

(54) METHOD OF SECURING FIREARMS

(76) Inventor: Richard E. Perkins, 10526 Willetts Crossing Rd., White Plains, MD (US) 20695

( * ) Notice: Subject to any disclaimer, the term of this patent is extended or adjusted under 35 U.S.C. 154(b) by 0 days.

(21) Appl. No.: 09/669,605

(22) Filed: Sep. 26, 2000

Related U.S. Application Data

(62) Division of application No. 09/337,697, filed on Jun. 21, 1999, now Pat. No. 6,122,851, which is a continuation of application No. 08/931,778, filed on Sep. 16, 1997, now Pat. No. 5,913,666.

(51) Int. Cl.[7] ..... F41A 17/02; F41A 17/42
(52) U.S. Cl. ..... 42/70.11; 42/70.08
(58) Field of Search ..... 42/70.01, 70.08, 42/70.11

(56) References Cited

U.S. PATENT DOCUMENTS

| | | | | |
|---|---|---|---|---|
| 4,048,741 A | | 9/1977 | Chiodo et al. | 42/70.11 |
| 4,392,318 A | | 7/1983 | Daniels | 42/70.11 |
| 4,961,277 A | | 10/1990 | Rosenbaum | 42/70.11 |
| 4,995,180 A | | 2/1991 | Tucker et al. | 42/70.07 |
| 5,099,596 A | | 3/1992 | Butler, Jr. | 42/70.11 |
| 5,245,776 A | | 9/1993 | Dornaus | 42/70.08 |
| 5,261,177 A | | 11/1993 | Armstrong | 42/70.08 |
| 5,331,759 A | | 7/1994 | Marceau et al. | 42/70.11 |
| 5,419,069 A | | 5/1995 | Mumbleau et al. | 42/70.11 |
| 5,446,988 A | | 9/1995 | Frederick, Jr. | 42/70.11 |
| 5,465,519 A | | 11/1995 | Blanck | 42/70.11 |
| 5,467,550 A | | 11/1995 | Mumbleau | 42/70.11 |
| 5,493,806 A | * | 2/1996 | Langevin et al. | 42/69.02 |
| 5,548,915 A | | 8/1996 | Szarmach et al. | 42/70.11 |
| 5,611,164 A | | 3/1997 | Rassias | 42/70.11 |
| 5,680,723 A | | 10/1997 | Ruiz | 42/70.11 |
| 5,732,497 A | | 3/1998 | Brooks | 42/70.08 |
| 5,913,666 A | | 6/1999 | Perkins | 42/70.11 |

* cited by examiner

*Primary Examiner*—Stephen M. Johnson
(74) *Attorney, Agent, or Firm*—Baker, Donelson, Bearman & Caldwell

(57) ABSTRACT

An apparatus and method for securing a firearm from firing by engaging a security lock to a slide at a butt end of the firearm. The security lock has a housing defined by a pair of sidewalls joined by a top plate that defines a slot for receiving a sight on the slide. A controller extends through a rear plate of the housing. A security member is operatively engaged to the controller for being moved between a first position for installing and removing the housing from the slide of the handgun and a second position in which the security member operatively secures the housing to the slide by being disposed between the rear portion of the slide and the handle of the firearm, thereby holding the slide in a partially rearward position with the firearm out-of-battery and the trigger mechanism of the firearm disengaged from the firing pin mechanism. A method of locking firearms is disclosed. The method discloses using a universal key for the lock.

3 Claims, 3 Drawing Sheets

METHOD OF SECURING FIREARMS

This application is a divisional of Ser. No. 09/337,697, filed Jun. 21, 1999, issued as U.S. Pat. No. 6,122,851 on Sep. 26, 2000, which is a continuation of Ser. No. 08/931,778, filed Sep. 16, 1997, issued as U.S. Pat. No. 5,913,666 on Jun. 22, 1999.

TECHNICAL FIELD

The present invention relates generally to devices for securing firearms from firing. More particularly, the present invention relates to selectively installed and removed securing device which locks firearm handguns from being fired accidently.

BACKGROUND OF THE INVENTION

Firearm safety is an important issue to persons who are involved in carrying and using firearms. Generally safe handling of firearms consists of proper education, training, and practice in the use, cleaning, and storage of firearms. However, concerns have recently been raised regarding the accessibility of firearms to unauthorized persons, such as children who are living at the home of a firearm owner or visiting such homes. Several legislatures have enacted statutes requiring firearm owners to keep firearms away from children. The purpose is to prevent accidental deaths and injuries to persons arising from the accidental discharge of a firearm by a child.

As a mechanism for reducing the number of such accidental shootings, police agencies are also being required to issue gun locks to officers carrying firearms. The use of the gun lock is mandated for securing the firearm from being fired, particularly while the officer is off-duty at home. The gun lock prevents accidental discharge of the secured firearm and thereby prevent injuries to persons, and prevents unauthorized persons, especially children, from accidently operating the firearm.

Various types of gun locks have been developed to provide a securing device for guns for owners wishing to secure the firearms from being fired accidentally. Among these are devices that engage the muzzle, that engage the trigger guard, and that restrict the slide of a handgun from movement. For example, one device provides a safety strap having a contoured opening which fits snugly over the hammer. The hammer is moved to a cocked position and distal ends of the strap are drawn tightly around the upper portion of the handle of the pistol and around the front of the trigger guard. The free ends of the straps overlap and are snapped together with snap fasteners.

Another quick-release safety device for revolvers has a block that is inserted within the muzzle of a handgun. A strap extends behind the hammer and has extending arms that receive a cap. The cap engages the muzzle block. The strap prevents the hammer from being retracted. Another similar device for immobilizing a revolver-type handgun provides an elastic strap which extends around the hammer. A pin attached to the strap is received within the bore of the muzzle. The device is installed by first wrapping the strap around the hammer, stretchingly elongating the elastic rubber strap and inserting the pin into the muzzle. The strap then retracts, pulling the pin within the muzzle, and preventing the hammer from rearward movement.

Securing devices have also been developed for use with semi-automatic slide-type handguns. One such device provides a locking mechanism which installs in the breech after the slide assembly is fully retracted and held in place by a slide catch. A foot, rotatable by a key-lock mechanism, engages beneath and between cartridge-retaining surfaces at the top of the magazine in order to secure the firearm locking mechanism to the top of the magazine. This device prevents the breech block from closing or the magazine from being removed. Another semi-automatic pistol having a moveable slide includes a built-in safety mechanism which is installed in a rear portion of the slide assembly. Circular apertures in the sidewalls receive a cylindrical body having a semi-circular rear block. Rotation of the body disposes the rear block between the hammer assembly and a rear face of the firing pin to prevent the hammer assembly from being completely received within the slide assembly and contacting the firing pin. The body also presses the firing pin a short distance forward as would normally occur with the manual safety of a semi-automatic pistol were moved to the on position and thereby disabling the operative connection between the trigger assembly and the hammer assembly.

While these devices operate for locking a firearm from firing, there are drawbacks to their use. In particular, some of the prior art devices require handling and manipulation of straps and locks around the trigger of the handgun. This is not in accord with safe firearm practices which preferably instruct a user of a firearm to avoid contacting or handling the trigger unless during an attempt to fire the weapon. Other devices have elastic bands which may stretch and become elongated and thereby defeat the purpose of holding the hammer from being moved pulling the trigger. Still other devices require insertion of components into the bore of the muzzle or the breech block. These devices accordingly engage operating surfaces of the firearm which raise additional risks of damage to the firearm and to the shooter using the firearm.

Many of these devices include a key-and-lock feature in order to lock the securing device in position. The lock prevents the device from being removed by unauthorized persons. The keys provided are distinct, whereby the owner of one security lock may not necessarily be able to unlock and release the securing device owned by another person. For law enforcement personnel and security officers, however this adds an additional key which must be carried with the typical many number of keys law enforcement personnel are expected to carry and have readily available.

Accordingly, there remains a need in the art for an improved gun lock for use with firearms. It is to the provision of such that the present invention is directed.

SUMMARY OF THE PRESENT INVENTION

The present invention solves the need in the art by providing a method of securing firearms from firing, which firearms have a slide rearwardly displaceable in a direction from a muzzle end towards a butt end when fired with the firearm in-battery, comprising the steps of: (a) moving the slide manually slightly rearwardly to disconnect the firearm from being in-battery for firing; (b) placing a housing over a sight that extends from a rearward portion of the slide, the housing having a pair of opposing side walls joined together by a top plate at respective distal ends, the top plate defining an engagement slot therein for receiving the sight therethrough; (c) moving a securing member from a disengaged position to an engaged position which operatively secures the housing to the slide in the partially rearwardly position in which a hammer of the handgun is disengaged from a firing pin mechanism to render the firearm out-of-battery; and (d) locking the securing member in the engaged position, whereby the securing member, being moved to the engaged position after inserting the sight at the rear portion of the slide of the handgun into the engagement slot in the top of the housing, restricts the slide from returning to an in-battery position and thereby holding the firearm disabled from firing.

The present invention further provides a method of securing firearms from firing. The slide is moved manually slightly rearwardly to disconnect the firearm from being in-battery for firing. The housing is placed over a sight extending from a rearward portion of the slide. The housing has a pair of opposing sidewalls joined together by a top plate at respective distal ends. The top plate defines an engagement slot therein for receiving the sight. The securing member is moved from a disengaged position to an engaged position in order to secure the housing to the slide in the partially rearward position in which the trigger mechanism of the firearm is disengaged from a firing pin mechanism in order to render the firearm out of battery. The securing member in the second position is disposed between the rear portion of the slide and an upper portion of the handle of the firearm. The securing member prevents the slide from returning to an in-battery position and thereby disables the firearm from accidental operation. In another aspect of the method of securing firearms from accidental firing, a lock is provided, whereby the securing member is locked in position to prevent removal of the housing.

In another aspect, the present invention provides a method of securing firearms from firing in which a device to restrict firing of a firearm is operatively engaged to the firearm. The device then is locked with a universal key to secure the device from being removed from the firearm and thereby securing the disablement of the firearm from firing.

Objects, features and advantages of the present invention will become apparent upon reading the following detailed description of the disclosed embodiment of the present invention, in conjunction with the appended drawings and claims.

DETAILED DESCRIPTION OF THE PREFERRED EMBODIMENTS

Figure 1:
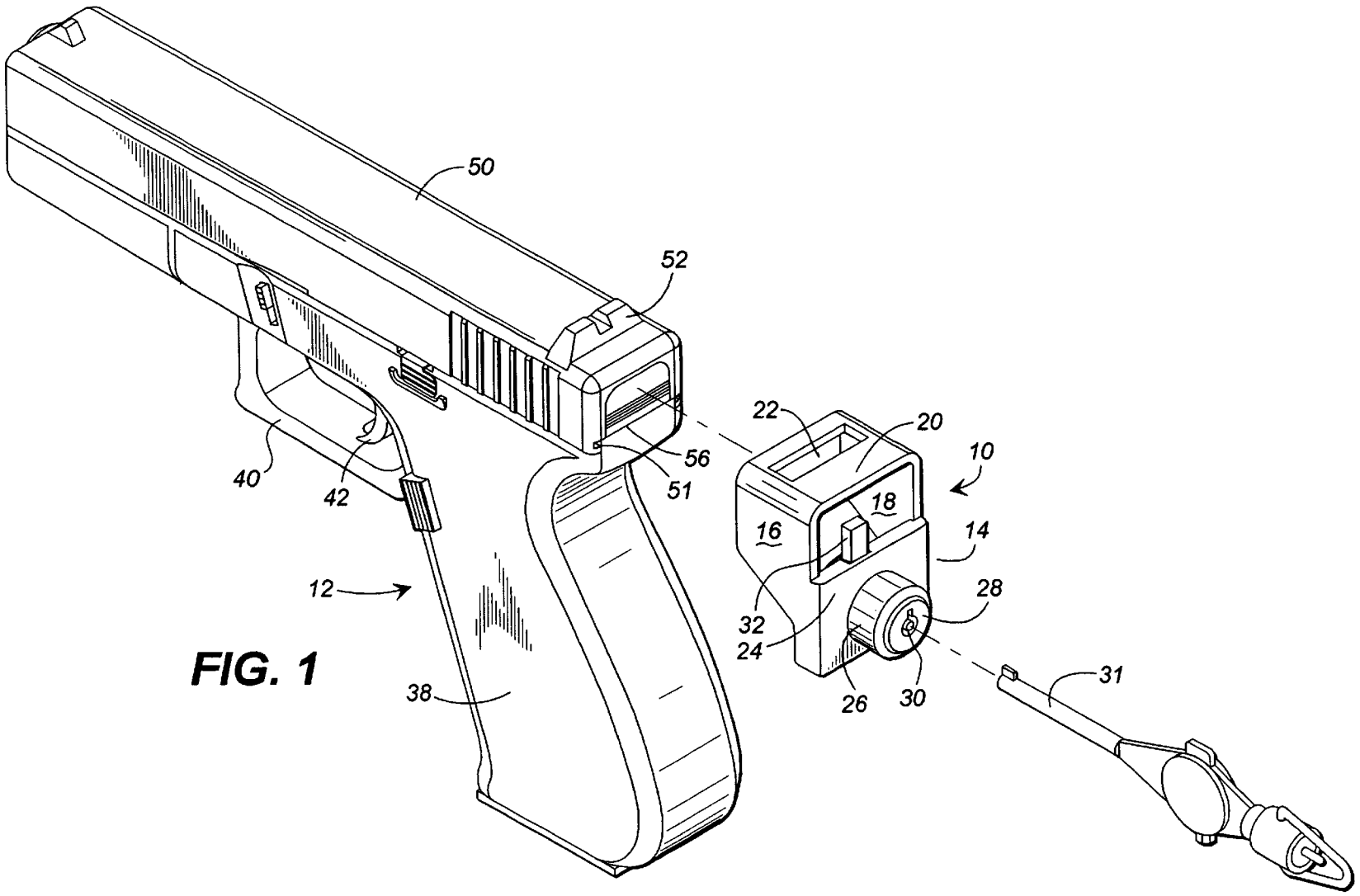
FIG. 1 is a perspective view of preferred embodiment of a firearm security lock and key according to the present invention, exploded from a firearm handgun to which the security lock attaches.
Figure 3:
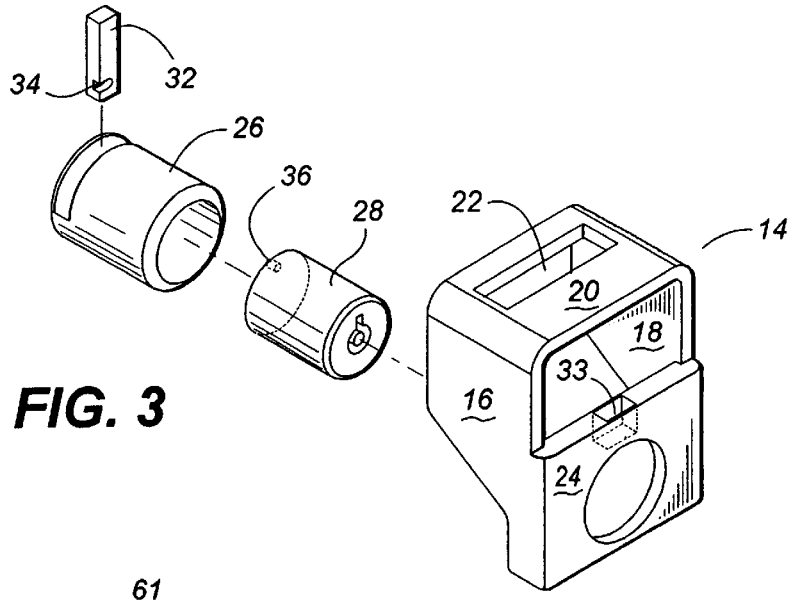
FIG. 3 is a perspective exploded view of the firearm security lock illustrated in FIG. 1.

Referring now in more detail to the drawings in which like parts have like identifiers, FIG. 1 is a perspective view of a firearm security lock 10 according to the present invention exploded away from a butt end of a firearm 12 to which the security lock attaches to secure the firearm for an accidental operation. FIG. 3 illustrates an exploded perspective view of the security lock 10. With continuing reference to FIGS. 1 and 3, the firearm security lock 10 comprises a housing 14 having a pair of opposing sidewalls 16 and 18 joined at distal ends by a top plate 20. The top plate 20 defines a slot 22. The housing 14 also has a back plate 24 from which a lock housing 26 extends laterally. A rotatable cylinder 28 is disposed within the lock housing 26 and includes a conventional key slot 30 and internally has a conventional cylinder lock assembly with pins that are selectively actuated by a key 31 for allowing the cylinder 28 to rotate. The cylinder 28 extends through the back plate 24 within the lock housing 26. A securing member 32 operatively connects to the cylinder 28. The securing member 32 is movable between a first position for installing the security lock 10 on the firearm and a second position which holds the security lock to the firearm. The cylinder lock 28 within the lock housing 26 accordingly defines a controller for moving the securing member 32.

In a preferred embodiment, the securing member 32 is an elongated metal bar having a notch 34. A cam pin 36 extends laterally of a distal end of the cylinder 28 and engages the notch 34. The securing member 32 is moveable vertically between a first position and a second position. A slot 33 on the back plate 24 guides the movement of the securing member 32. In the first position, the securing member 32 is retracted away from the top plate 20 whereby the housing 14 can be installed and removed from the firearm 12. In the second position, the securing member 32 is disposed within an interior cavity 55 of the firearm 12 to hold the housing 14 engaged to the firearm 12. The second position is best illustrated in FIG. 2 in which the slide-type firearm 12 is shown in cut-away side view with the firearm security lock 10.

Figure 2:
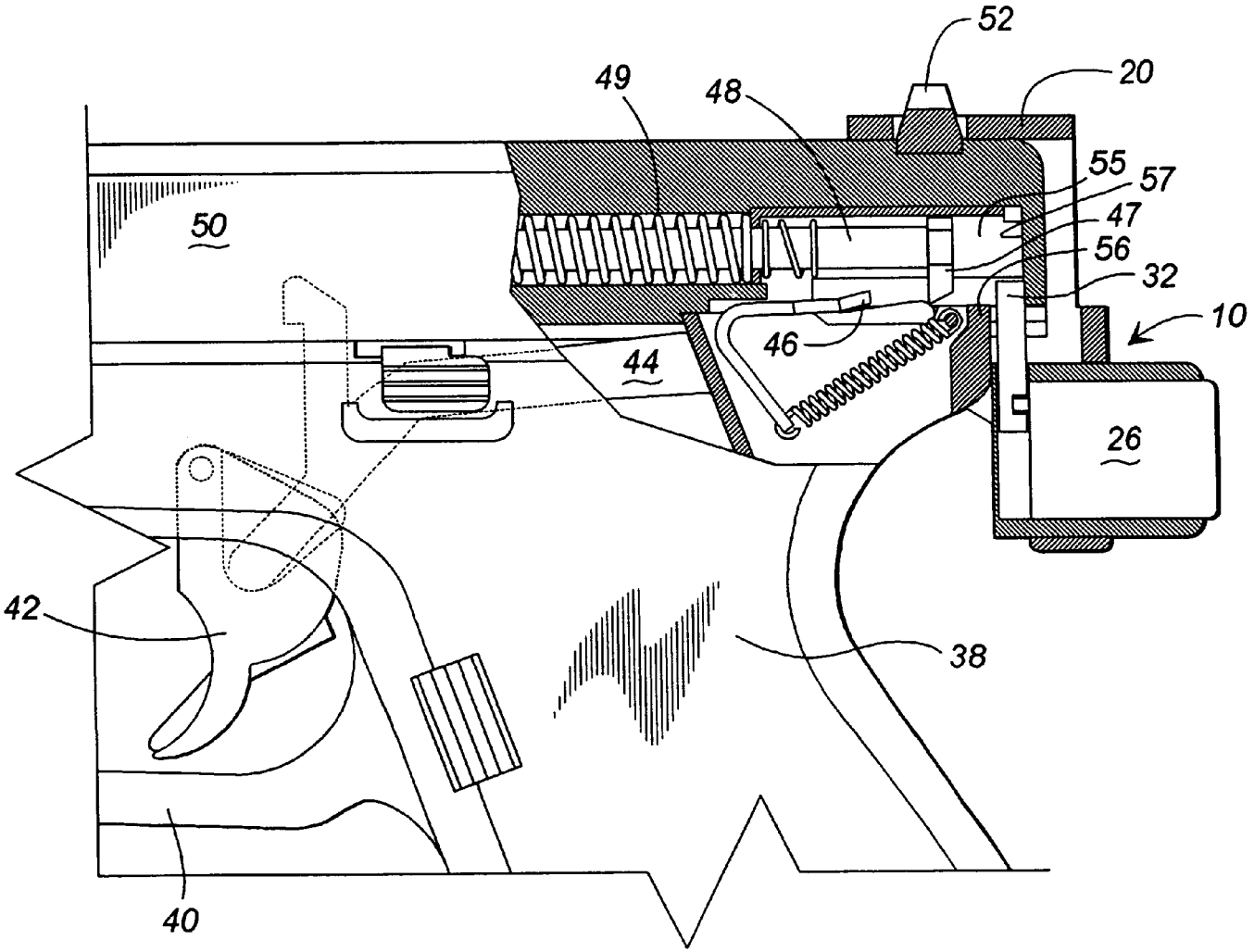
FIG. 2 is a side view of the firearm security lock illustrated in FIG. 1 engaged to a butt end of the firearm.

With continuing reference to FIGS. 1 and 2, the firearm 12 is representative of firearms having a trigger assembly that operates a firing pin. The illustrated firearm 12 includes a handle 38 with a slide 50 which engages and travels on rails 51 in the handle. A trigger guard 40 covers a trigger 42 that connects through a trigger bar 44 to a sear 46 which operatively engages a tang or nose 47 of a firing pin 48. As the trigger 42 is pulled, the trigger bar 44 causes the sear 46 to move the firing pin 48 rearwardly. The sear 46 reaches its maximum movement and releases from the nose 47 of the firing pin 48. The firing pin 48 releases and is driven by a firing pin spring 49 into engagement with a cartridge in the breech. The slide 50 engages the rails 5 on the handle 38 and is movable longitudinally relative to a muzzle of the firearm 12. The slide 50 includes a rear sight 52.

In FIG. 2, the firearm security lock 10 is shown attached to the slide 50 of the firearm 12. The sight 52 extends through the slot 22. The securing member 32 is in the second position within the cavity 55 at the butt end of the slide 50. The cavity 55 is defined by a rearward upper edge portion 56 of the handle 38 and an interior rearward end 57 of the slide 50. The securing member 32 holds the slide 50 in a slightly rearward position in which the firearm 12 is out-of-battery. By this is meant that the trigger bar 44 is disengaged from the firing pin 48, so that even if the trigger 42 were to be pulled, the firing pin would not be driven into the cartridge.

Figure 4:
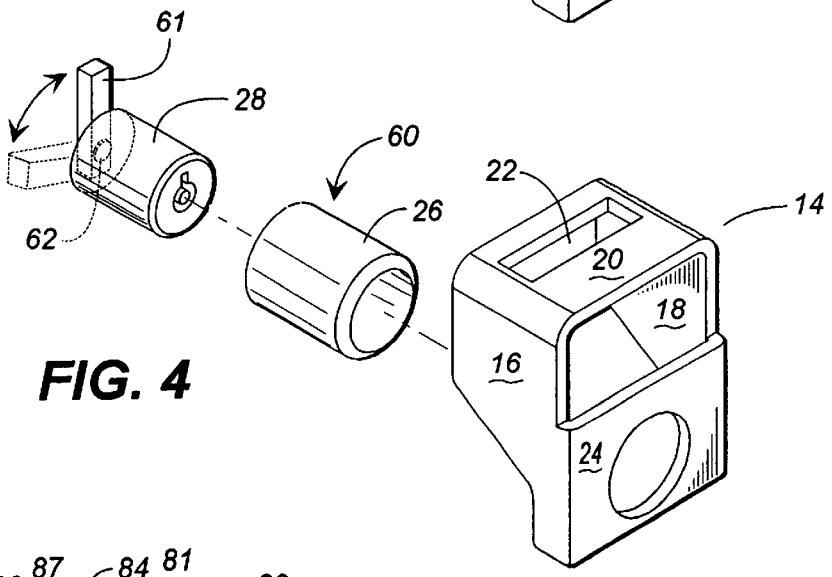
FIG. 4 is a perspective exploded view of an alternate embodiment of the firearm security lock illustrated in FIG. 1.

FIG. 4 is a perspective exploded view of an alternate embodiment 60 of the firearm securing lock 10. In this embodiment, a securing member 61 comprises an elongated metal bar which is connected at a first end 62 to the distal end of the cylinder 28. The securing member 61 is pivotable from a first position (shown in phantom) for installing and removing the housing 14 on the firearm 12 to a second position whereby the securing member 61 is disposed in the cavity 55 of the slide 50.

Figure 5:
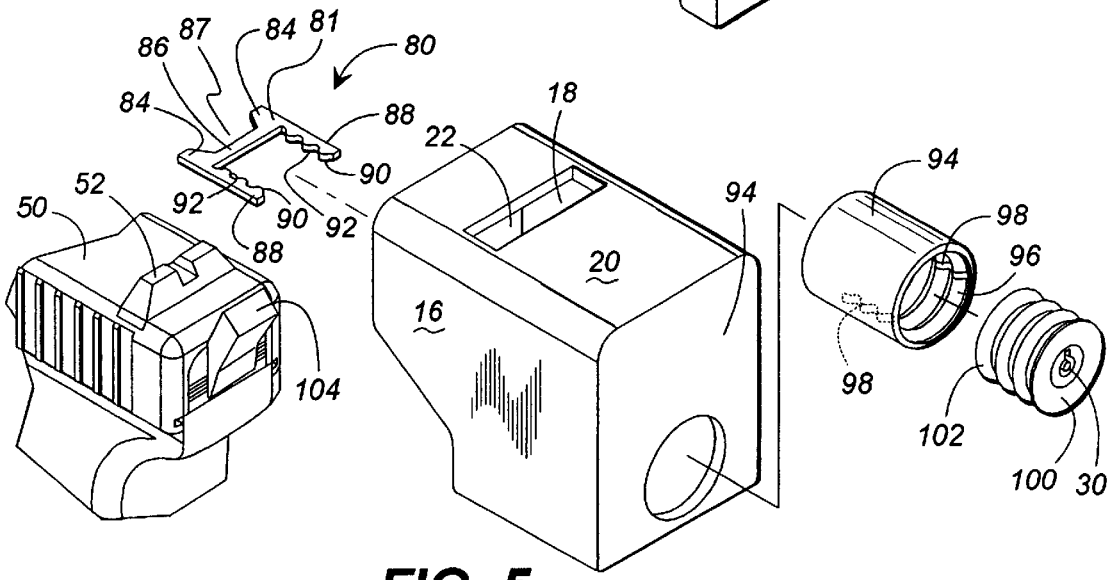
FIG. 5 is a perspective exploded view of an alternate embodiment of the firearm security lock device having a U-shaped yoke, for use with hammer-type firearms.

FIG. 5 is a perspective exploded view of an alternate embodiment of the firearm security lock 10 according to the present invention, particularly for use with conventional hammer-type firearms. In this embodiment, a securing member 80 comprises a plate 81 which defines a generally U-shape yoke 82. The plate 81 has a pair of arms 84 that extend in a first direction from a transverse portion 86. The pair of arms 84 are spaced-apart to define a recess 87 in an edge of the plate 81, for a purpose discussed below. The arms 84 and the recess 87 cooperatively define a generally U-shaped yoke. A pair of guide arms 88 extend in a second direction opposite the first direction in spaced-apart parallel relation. An inside edge 89 of each arm 88 defines a series of circular segments 90, 92 whereby the inside edge has a scalloped or undulated edge, for a purpose discussed below.

A lock housing 94 defines an inner surface 96. The lock housing 94 in the illustrated embodiment is mounted internal to the housing 14, but in an alternate embodiment, (not illustrated) the lock housing 94 is mounted external, similar to the lock housing 26 shown in FIG. 1. A pair of channels 98 are defined in opposing portions of the surface 96. The channels 98 receive the sides of the arms 88 in sliding relation. A cylindrical lock 100 having a threaded exterior 102 is received within the lock housing 94. The exterior 102 matingly engages the inside edge 89 of the arms 88, whereby the segments 90, 92 engage the thread of the lock 100. Rotation of the lock 100 causes the threads to bear against the segments 90, 92 and move the plate 81 relative to the housing 14, as discussed below.

With reference to FIGS. 1–3, the firearm securing lock 10 of the present invention is installed on the butt portion of the firearm 12 to secure the firearm from accidental operation. First, the slide 50 is slightly retracted to open a gap between the rearward upper edge portion 56 of the handle 38 and the interior rearward end 57 of the slide 50. Second, the housing 14 is attached to the slide 50 by inserting the sight 52 through the slot 22 and pivoting the housing downwardly to align the sides 16 and 18 with the sides of the slide. Third, the securing lock is secured to the firearm 12. The key 31 is inserted in the key slot 30 and twisted to rotate the cylinder 28 within the lock housing 26. The cam pin 36, engaged in the notch 34, moves in an arc as the cylinder 28 is rotated. This causes the securing member 32 to move vertically between the first position retracted from the top plate 20 to the second position in the cavity 55. The slot 33 guides the travel of the securing member 32. The key 31 is removed from the cylinder 28. The firearm security lock 10 is thereby secured to the slide 50. The slide 50 is released. The securing member 32 however blocks the complete return travel of the slide 50 and holds the firearm 12 out-of-battery. The trigger 42 and its connecting assembly is disengaged from the firing pin assembly so that even if the trigger were to be pulled, the firing pin 48 would not be driven into a cartridge. The firearm 12 is thereby rendered inoperative and is held out-of-battery by the firearm security lock 10. In order to remove the security lock 10, the slide 50 is slightly retracted, the key 31 is inserted into the cylinder 28 and rotated. The securing member 32 is thereby moved from the second position to the first position. The housing 14 is grasped on the sides 16 and 18 and with an upward and pivotable movement, the security lock 10 is detached from the firearm 12. The slide 50 is allowed to return forwardly on the firearm 12 and thereby place the firearm in-battery for operation.

In the alternate embodiment illustrated in FIG. 4, the cylinder 28 rotates to pivot the securing member 61 from the first position (shown in phantom) to the second position within the cavity 55 for holding the firearm 12 out-of-battery.

The embodiment illustrated in FIG. 5 is particularly suited for use with hammer-type firearms. The slide 50 is slightly retracted away from the muzzle of the firearm. The housing 14 is placed on the butt end of the slide by inserting the sight 52 into the slot 22 and pivoting the housing 14 towards the handle of the firearm. The hammer 104 of the firearm is received in the recess 87 of the plate 81. The key 31 is received in the key slot 30 of the lock 100. Rotation of the lock 100 causes the threads on the lock 100 to engage the segments 90, 92 of the arms 88 and thereby move the plate 81 axially. The plate 81 moves from a first position retracted within the housing 14 to a second position extended from the housing 14. The distal ends of the arms 84 contact the rails 51 in the upper edge of the handle 38. The key 31 is removed. The security lock 10 is thereby fixed to the slide 50 with the plate 81 extended from the housing 14 to the second position. The slide 50 is released, but the plate 81 being in the extended, or second position, in the housing 14, holds the firearm 12 out-of-battery, whereby the firearm is secured from accidental operation.

The firearm security lock of the embodiment illustrated in FIG. 5 is likewise easily removed by moving the plate 81 from the second position to the first position. This is accomplished by inserting the key 31 into the cylinder lock 100 and rotating in order to retract the plate 81 into the housing 14 to the first position. The security lock 10 is removed from engagement with the butt end of the slide 50 by a pivoting upward movement of the housing 14.

The present invention accordingly provides a firearm security lock which is easily installed and removed, being secured to the firearm by a lock actuated by a key. The present invention interposes a securing member between the rear portions of the slide and the handle to restrain the slide from return travel and thereby holding the firearm out-of-battery. According to the present invention, the cylinder lock is of conventional construction and operation. Because security personnel, police officers, and other individuals carrying firearms typically have a large number of keys they are required to carry, the method of the present invention provides a universal key for locking and unlocking the firearm security lock 10 of the present invention. In particular, the universal key preferably comprises a key that police officers are already carrying for another purpose. In a preferred embodiment, the universal key comprises a conventional handcuff key. In this way, the police officers are encouraged to use the firearm security lock 10 of the present invention, in that a universal key already carried by the officer operates the security lock.

The principles, preferred embodiments, and modes of operation of the present invention have been described in the foregoing specification. The invention is not to be construed as limited to the particular forms disclosed because. these are regarded as illustrative rather than restrictive. Moreover, variations and changes may be made by those skilled in the art without departure from the spirit of the invention as described by the following claims.

What is claimed is:

1. A method of securing firearms from firing, which firearms have a slide rearwardly displaceable in a direction from a muzzle end towards a butt end when fired with the firearm in-battery, comprising the steps of:

(a) moving the slide manually slightly rearwardly to disconnect the firearm from being in-battery for firing;

(b) placing a housing over a sight that extends from a rearward portion of the slide, the housing having a pair of opposing side walls joined together by a top plate at respective distal ends, the top plate defining an engagement slot therein for receiving the sight therethrough;

(c) moving a securing member from a disengaged position to an engaged position which operatively secures the housing to the slide in the partially rearwardly position in which a hammer of the handgun is disengaged from a firing pin mechanism to render the firearm out-of-battery; and (d) locking the securing member in the engaged position, whereby the securing member, being moved to the engaged position after inserting the sight at the rear portion of the slide of the handgun into the engagement slot in the top of the housing, restricts the slide from returning to an in-battery position and thereby holding the firearm disabled from firing.

2. The method for securing firearms as recited in claim 1, wherein the step (d) of locking is accomplished using a universal key.

3. The method for securing firearms as recited in claim 1, wherein the step (d) of locking is accomplished using a handcuff key.

* * * * *